US006463682B1

(12) United States Patent
Carroll, Jr.

(10) Patent No.: US 6,463,682 B1
(45) Date of Patent: Oct. 15, 2002

(54) GOLF CLEAT WITH QUICK ATTACH AND LOCK AND OUTWARDLY ANGLED FACETED TEETH

(75) Inventor: James Carroll, Jr., Richboro, PA (US)

(73) Assignee: Green Keepers, Inc., Warminster, PA (US)

( * ) Notice: Subject to any disclaimer, the term of this patent is extended or adjusted under 35 U.S.C. 154(b) by 0 days.

(21) Appl. No.: 09/774,018

(22) Filed: Jan. 31, 2001

Related U.S. Application Data

(63) Continuation-in-part of application No. 09/027,867, filed on Feb. 23, 1998, which is a continuation-in-part of application No. 08/802,908, filed on Feb. 20, 1997, now Pat. No. 5,794,367.

(60) Provisional application No. 60/179,481, filed on Feb. 1, 2000.

(51) Int. Cl.[7] ..... A43C 15/16

(52) U.S. Cl. ..... 36/134; 36/127; 36/67 D

(58) Field of Search ..... 36/127, 67 D, 36/67 R, 134

(56) References Cited

U.S. PATENT DOCUMENTS 39,575 A * 8/1863 Hyatt et al.
3,656,245 A * 4/1972 Wilson
4,014,114 A * 3/1977 Jordan et al.
5,036,606 A * 8/1991 Erich et al.
5,306,606 A 4/1994 Tachibana et al. ..... 430/533
5,321,901 A * 6/1994 Kelly
5,524,367 A * 6/1996 Ferreira et al.
5,794,367 A 8/1998 Carroll ..... 36/134
5,887,371 A * 3/1999 Curley, Jr.
5,974,700 A * 11/1999 Kelly
6,023,860 A * 2/2000 McMullin

* cited by examiner

*Primary Examiner*—M. D. Patterson
(74) *Attorney, Agent, or Firm*—Jim Zegeer

(57) ABSTRACT

A golf cleat of the type having a base member and a plurality of outwardly angled traction teeth with the traction teeth having multifaceted design, and a mounting arrangement on the underside of the base member. The mounting arrangement includes a mounting stud having a multi-start thread and at least one locking post which coact with annular locking formations in the receptacle to thereby provide a stud having a multi-start thread complementary to the multi-start thread of the socket or receptacle whereby a simple quarter-turn of the cleat is fitted in its place with the locking formations on the thread engaged with the quadrant post to retain the cleat in the socket.

7 Claims, 2 Drawing Sheets

GOLF CLEAT WITH QUICK ATTACH AND LOCK AND OUTWARDLY ANGLED FACETED TEETH

REFERENCE TO RELATED APPLICATIONS

The present application is the subject of provisional application Ser. No. 60/179,481 filed Feb. 1, 2000 for GOLF CLEAT WITH QUICK ATTACH AND LOCK AND OUTWARDLY ANGLED FACETED TEETH and is a continuation-in-part application of Ser. No. 09/027,867 filed Feb. 23, 1998 which in turn is a continuation-in-part of Ser. No. 08/802,908 filed Feb. 20, 1997, now U.S. Pat. No. 5,794,367.

BACKGROUND AND BRIEF DESCRIPTION OF THE INVENTION

The present invention is related to Carroll U.S. Pat. No. 5,794,367 (incorporated by reference) and is directed to improvements in the attachment and locking mechanism for the cleats and to improvements in the design of the outward angled teeth, namely, the outwardly angled teeth are broader and have oversized traction teeth which angle outwardly with superior traction. Moreover, the multifaceted design delivers traction with less surface area at the points of contact for more effective damage control. In addition, the design is wear resistant for delivering diamond-like durability and a high average rounds per set of cleats.

In connection with the mounting arrangement, the mounting stud and locking assembly are designed to fit a socket which is provided with a receptacle incorporated in a shoe sole, either molded in or fitted in later, and with a multi-start thread and having an annular ring of locking formations thereon if the type disclosed in U.S. Pat. No. 5,036,606, incorporated by reference.

The cleat of this invention has a multi-start threaded mounting stud and at least one locking post which coacts with the locking formations in a receptacle mounted in a golf shoe. Thus, with the mounting studs having a multi-start thread complementary to the multi-start thread of the socket, a simple quarter-turn clockwise and the cleat is fitted in its place with the locking formations on the socket engaged with the locking post(s) to retain the cleat in the socket. In addition, the threads may be provided with formations which provide additional cleat retention, and, thus, the cleat is doubly locked in place.

BRIEF DESCRIPTION OF THE DRAWINGS

The above and other objects, advantages and features of the invention will become more apparent when considered with the following specification and accompanying drawings wherein.

DETAILED DESCRIPTION OF THE INVENTION

Figure 1:
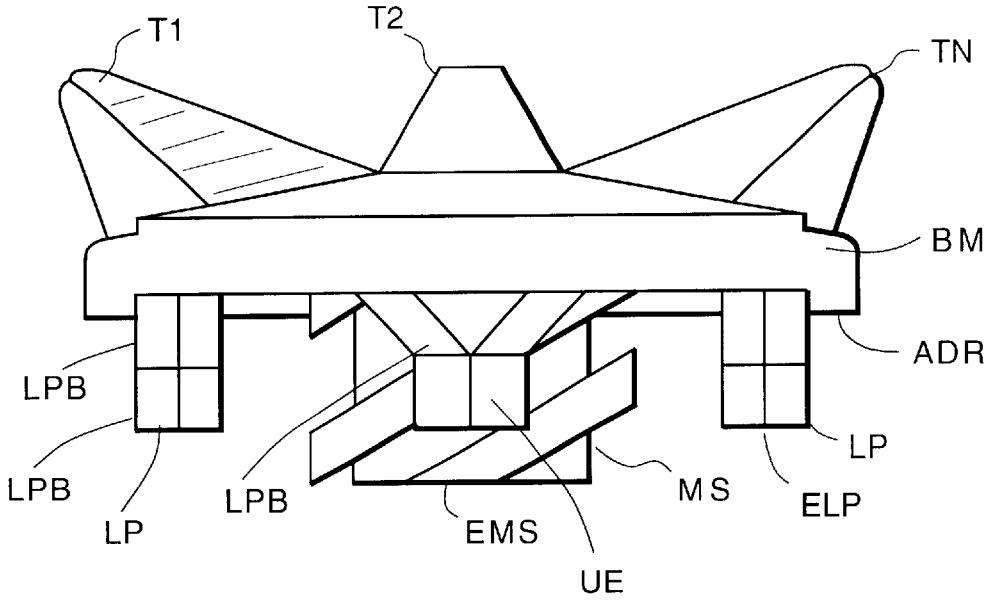
FIG. 1 is a side elevational view of the cleat showing the multi-start threaded mounting stud and the plurality of locking posts which in one embodiment can be the four quadrants and in another embodiment can just be at least one or more locking posts.
Figure 2:
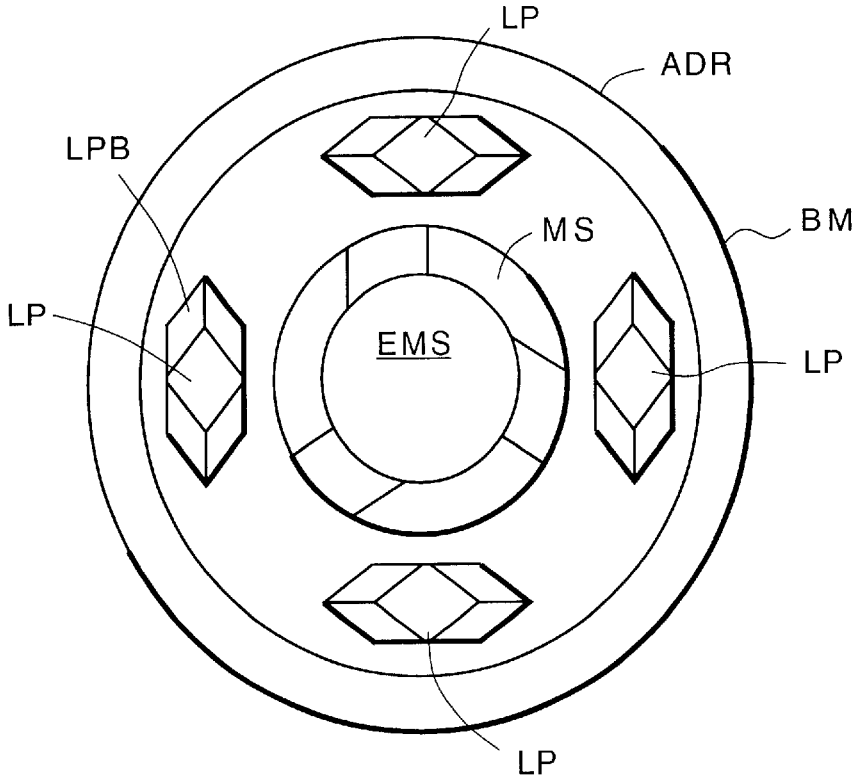
FIG. 2 is a bottom plan view of the cleat showing the locking posts and multi-start mounting post, FIG. 3 (prior art) is a plan view of a shoe socket or receptacle known under the trademark FAST TWIST with which the locking post of the cleat of the present invention is adapted to coact, and FIG. 4 (prior art) is a side elevational view thereof.

Referring to FIGS. 1 and 2, the arrangement of traction teeth T1, T2 . . . TN and optional central wear pad (not shown) on a base member BM is generally of the character disclosed in U.S. Pat. No. 5,794,367 (owned by the assignee hereof) which is incorporated herein by reference. In this case, the outwardly angled traction teeth T1, T2 . . . TN are broader and have oversize traction teeth which angle outwardly for superior traction. Moreover, the multi-faceted design delivers traction with less surface area at the points of contact for more effective damage control. In addition, the design is wear resistant for delivering diamond-like durability and a high average use per set of cleats. An anti-debris rim ADR is provided as disclosed in the above-reference U.S. Ser. No. 09/027,867.

Figure 3:
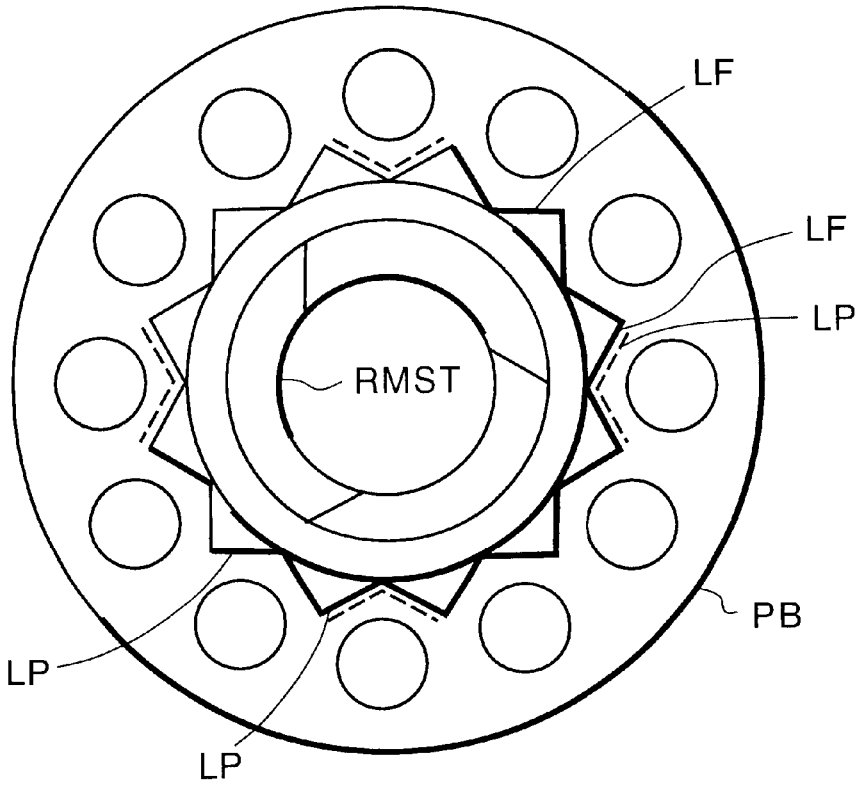
FIG. 3 (Prior Art)
Figure 4:
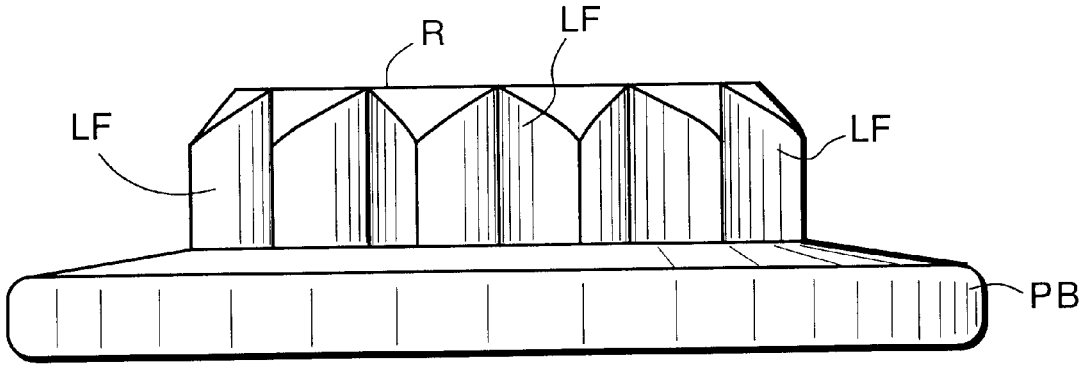
FIG. 4 (Prior Art)

Turning now to the mounting arrangement, as noted earlier, the invention is particularly adapted for use with receptacles (shown in FIGS. 3 and 4) sold under the trademark FAST TWIST embedded in a shoe sole and having a base PB, a ring of locking formations LF and a multi-start female thread RMST. The mounting arrangement of the present invention incorporates a central male multi-start threaded mounting stud MS having one or more locking posts LP (four shown, one in each quadrant) which coact with the annular or cylindrical locking formation LF in the receptacle. Thus, with the mounting stud having a multi-start thread complementary to the multi-start thread RMST of the socket or receptacle REC, a simple quarter-turn clockwise and the cleat is fitted into its place with the locking formations LF on the socket engaged with the locking post(s) LP to retain the cleat in the socket. In addition, the multi-start threads may be provided with formations which provide additional cleat retention as disclosed in the aforementioned U.S. Pat. No. 5,794,367, and so the cleat is doubly locked in place.

Each locking post LP has an upwardly tapered, faceted base LPB which has facets and an upper end UE which is diamond-shaped in cross-section and deflect to interfit with locking formations LF of the socket or receptacle REC. Note that the end EMS of multi-start stud MS extends below the ends ELP of the locking post(s) so the male EMS and female RMST threads engage prior to the locking post(s) LP engage the locking formations LF. In one preferred embodiment, there are two or three locking posts. In another preferred embodiment there are four locking posts as shown in FIG. 2.

While the invention has been described in relation to preferred embodiments of the invention, it will be appreciated that other embodiments, adaptations and modifications of the invention will be apparent to those skilled in the art.

What is claimed is:

1. A golf cleat for mounting on a shoe receptacle having a female multi-start thread and an annular locking formation, said golf cleat having a base member with an upside and a downside, a plurality of outwardly angled traction teeth with the traction teeth having multifaceted design on said downside, a mounting arrangement on the upside of said base member, said mounting arrangement including a mounting stud having a male multi-start thread and a plurality of locking posts which coact with the annular locking formation in said receptacle, said locking posts have a tapered base portion, whereby with a simple quarter-turn of the cleat it is fitted in its place with the annular locking formations on the shoe receptacle engaged with the locking posts to retain the cleat in the receptacle.

2. The golf cleat defined in claim 1 wherein the end of each of said locking posts are diamond-shaped.

3. The golf cleat defined in claim 1 wherein said mounting stud has a lower end which is below the lower ends of said locking posts.

4. A golf cleat for mounting on a shoe receptacle having a female multi-start thread and an annular locking formation, said golf cleat comprising a base member having an upside and a downside, a plurality of outwardly angled traction teeth on said downside, a mounting arrangement on the upside of said base member for mounting in said shoe receptacle, said mounting arrangement including a mounting stud having a male multi-start thread and a plurality of locking posts which coacts with said annular locking formations on said receptacle, said locking posts having a tapered base, whereby with a simple quarter-turn of said golf cleat, said golf cleat is fitted in its place with said annular locking formations on said shoe receptacle engaged with said plurality of locking posts to retain said cleat in said receptacle.

5. A golf cleat defined in claim 3 wherein said base member includes an anti-debris ring on said upside wherein said locking posts are diamond-shaped.

6. A golf cleat as defined in claim 3 wherein said locking posts are diamond-shaped.

7. A golf cleat as defined in claim 4 wherein said locking stud has a lower end which is below the lower ends of said locking posts.

* * * * *